US005662491A

United States Patent [19]

Antilla et al.

[11] Patent Number: 5,662,491

[45] Date of Patent: Sep. 2, 1997

[54] ELECTRICAL CONNECTOR FOR VEHICLE POWER COMPONENT SWITCHES

[75] Inventors: John V. Antilla, Sterling Heights; Samuel G. Griffith, West Bloomfield; Michael R. Olechiw, Hartland, all of Mich.

[73] Assignee: Chrysler Corporation, Auburn Hills, Mich.

[21] Appl. No.: 568,929

[22] Filed: Dec. 7, 1995

[51] Int. Cl.[6] ..... H01R 4/50

[52] U.S. Cl. ..... 439/342; 439/686

[58] Field of Search ..... 439/535, 357, 439/358, 685, 686, 683, 510, 342

[56] References Cited

U.S. PATENT DOCUMENTS

| | | | |
|---|---|---|---|
| 2,489,741 | 11/1949 | Bonham | 173/330 |
| 3,202,959 | 8/1965 | Keller | 439/685 |
| 4,046,452 | 9/1977 | Cassarly | 339/198 |
| 4,210,382 | 7/1980 | Culbertson | 339/192 |
| 4,653,228 | 3/1987 | Yuhas et al. | 49/357 |
| 4,671,599 | 6/1987 | Olsson | 439/188 |
| 4,838,807 | 6/1989 | Takinori et al. | 439/347 |
| 4,899,063 | 2/1990 | Suck | 307/9.1 |
| 5,108,300 | 4/1992 | Weber | 439/188 |
| 5,171,161 | 12/1992 | Kachlic | 439/352 |
| 5,478,244 | 12/1995 | Maue et al. | 439/510 |

*Primary Examiner*—P. Austin Bradley
*Assistant Examiner*—Yong Ki Kim
*Attorney, Agent, or Firm*—Margaret A. Dobrowitsky

[57] ABSTRACT

An electrical connector for a vehicle has a receptacle base formed with preferably five receptacles for receiving complementary electrical pins on a vehicle power switch. The power switch is associated with a power component, e.g., a power window, power sun roof, or power door lock, for operating the power component. The receptacle base is reciprocatingly engaged with a hollow locking cover, and is movable between a locked position, wherein opposed keeper ribs on the receptacle base snappingly engage respective cavities formed on the locking cover, and an unlocked position, wherein the ribs are distanced from the cavities. Opposed retainer ears are formed on the locking cover for snappingly engaging complementary structure on the power switch to hold the power switch in a fixed relationship with the receptacle base when the locking cover is in the locked position. An electrical contact having opposed bight-shaped contact elements is positioned in each receptacle for electrically contacting one of the pins of the power switch.

16 Claims, 2 Drawing Sheets

ELECTRICAL CONNECTOR FOR VEHICLE POWER COMPONENT SWITCHES

FIELD OF INVENTION

The present invention relates generally to vehicles, and more particularly to electrical connectors for power switches for operating vehicular power windows, power sun roofs, power door locks and the like.

BACKGROUND OF THE INVENTION

Many modern vehicular components can be power operated by an occupant of a vehicle. For example, many vehicles now incorporate power door locks, power windows, power sun roofs, and the like. Typically, a 5-pole spring-loaded power switch is provided for each power component, with the switch being manipulable by an occupant of the vehicle to operate the associated power component.

It will readily be appreciated that an automotive power switch must be connected to the electrical power and signal distribution system of the associated automobile. Accordingly, switch connectors have been provided for connecting power switches to electrical circuits. One example of such a connector is disclosed in U.S. Pat. No. 4,210,382 to Culbertson.

As disclosed in Culbertson, a single piece housing is formed with five receptacles for receiving the five male pins of an automotive power switch therein. Unfortunately, Culbertson requires the use of a special tool to engage and disengage the switch from the connector, thus complicating assembly, removal from, and replacement of, the switch.

Further, single piece connectors typically include retainer arms for holding the switch in engagement with the connector. While effective in holding a switch in engagement with a connector, the retainer arms tend to materially fatigue and eventually break after several connections and disconnections. This is because the arms must be deformed to allow passage of the power switch therebetween each time the power switch is engaged or disengaged with the connector. Also, to allow the power switch to clear the arms when engaging or disengaging the connector, the power switch must be pulled away from the connector while both arms are simultaneously pulled apart from each other. This is cumbersome and tends to further damage the arms.

Still further, previous power switch connectors have tended to require the use relatively high forces to connect and disconnect the switch from the connector. And, the metal pin receivers that are positioned in the housings of previous connectors are afforded little if any overstress protection, as would otherwise be desirable to limit damage to the pin receivers when oversized objects are mistakenly advanced into the receptacles.

Accordingly, it is an object of the present invention to provide a connector for vehicle power switches which can interconnect a power switch with the electrical system of the vehicle. Another object of the present invention is to provide an electrical connector for vehicle power component switches that is easy to use and cost-effective to manufacture.

SUMMARY OF THE INVENTION

An electrical connector for engaging a power switch of a vehicle includes a receptacle base which is configured for operatively engaging the power switch. A locking cover is reciprocatingly engaged with the receptacle base, and the locking cover includes opposed retainer ears. In accordance with the present invention, the locking cover is movable between a locked position, wherein the retainer ears engage the power switch to hold the power switch in a fixed relationship with the receptacle base, and an unlocked position, wherein the power switch can be disengaged from the receptacle base and moved past the locking ears substantially without deforming the locking ears.

Preferably, at least one keeper is rib formed on the receptacle base, and at least one cavity is formed on the locking cover for snappingly receiving the keeper rib to hold the locking cover in the locked position. Advantageously, at least one retainer arm is formed on the receptacle base. A limiter aperture is formed in the locking cover for cooperating with the retainer arm to limit reciprocal movement of the locking cover relative to the retainer base.

In the preferred embodiment, the power switch includes a plurality of electrical pins protruding outwardly therefrom. In this preferred embodiment, the retainer base includes a plurality of receptacles configured for respectively receiving one of the pins of the power switch therein. Moreover, a respective electrical contact is disposed in each receptacle and is configured for closely receiving one of the pins of the power switch to thereby establish an electrical communication path from the power switch to the electrical contact.

In a particularly preferred embodiment, each electrical contact is formed with at least two contact elements which establish a pin channel for closely receiving a respective pin of the power switch therein. As intended by the present invention, the contact elements are materially biased to urge against the pin of the power switch when the power switch is engaged with the receptacle base. More specifically, each contact element defines an inner leg, an outer leg facing the inner leg, and a bight therebetween, with the inner leg of each contact element being formed with a pressure foot for contacting the outer leg and thereby limiting the deformation of the contact element when the pin is engaged with the pin channel of the electrical contact. A vehicle which incorporates the electrical connector is also disclosed.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
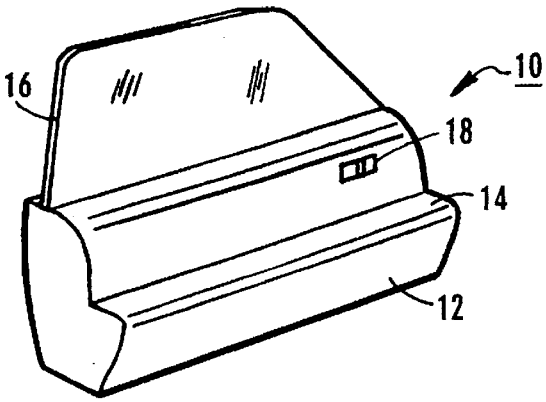
FIG. 1 is a perspective view of a power window switch positioned on the inside panel of a vehicle door.

Referring initially to FIG. 1, a vehicle, generally designated 10, includes a door 12 having an inner panel 14 and a window with motor 16. The window with motor 16 is a power component; accordingly, a power window switch 18 is mounted on the panel 14 by means well-known in the art to enable an occupant of the vehicle 10 to raise and lower the window 16 by appropriately manipulating the switch 18.

While FIG. 1 shows, for illustration purposes, that switch 18 is a power window switch for operating the power window 16, it is to be understood that the switch 18 can alternatively be used to operate some other occupant-operated power component of the vehicle 10. For example, the switch 18 can be operatively engaged with power door lock motors, power sun roof motors, or some other power component of the vehicle 10. Indeed, the switch 18 shown in FIG. 1 is a standard 5-pole vehicle power switch which is used in various vehicle power component applications, including but not limited to the ones mentioned above.

Figure 2:
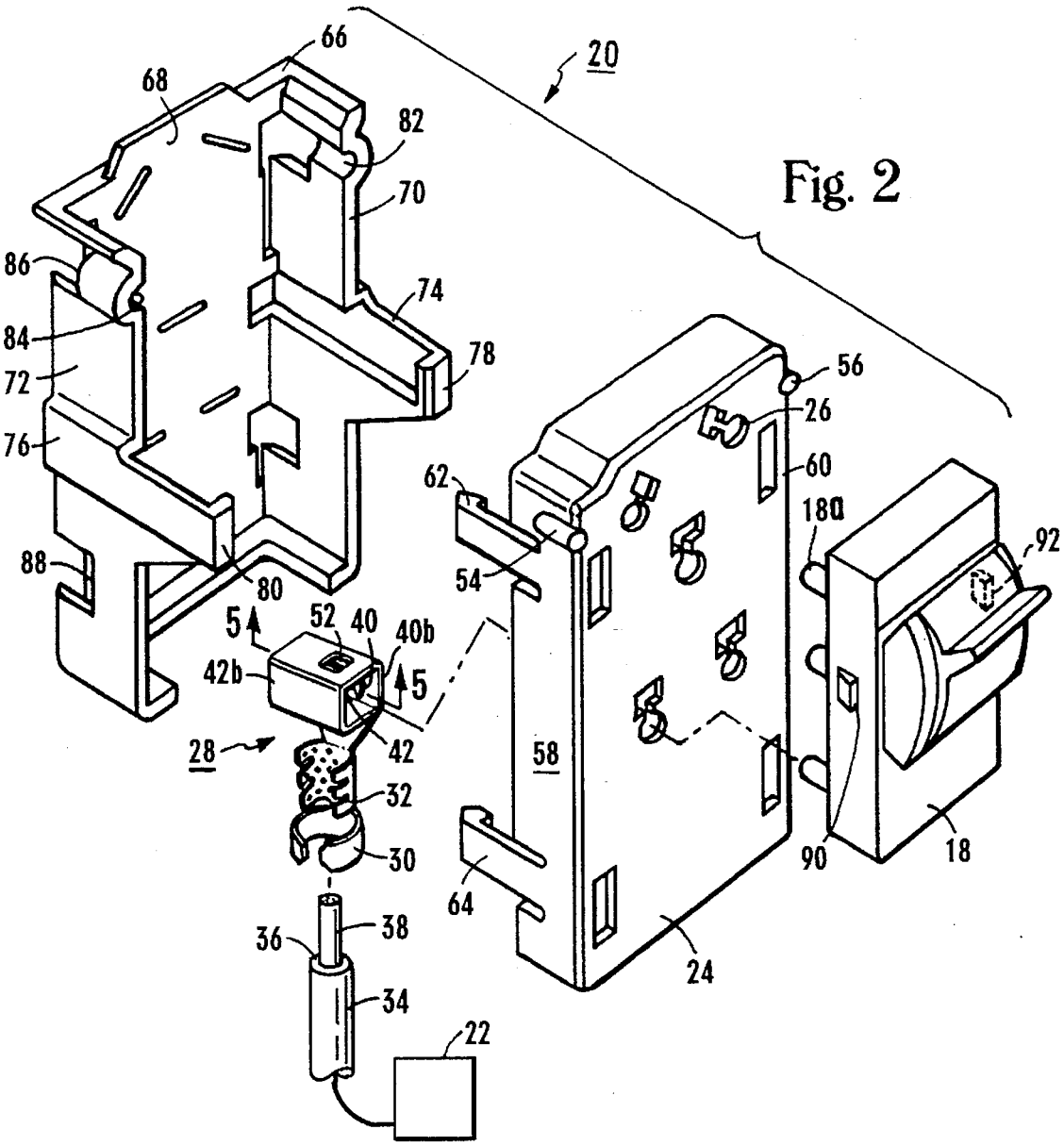
FIG. 2 is a perspective view of the connector for power switch, in an exploded relationship with the power switch shown in FIG. 1, with the power and control circuitry of the vehicle shown schematically.

The details of the present invention can best be seen in FIG. 2. As shown in FIG. 2, a connector, generally designated 20, can be engaged with the power switch 18 to connect the switch 18 to the electrical power and control circuitry 22 of the vehicle 10.

In the preferred embodiment shown in the figures, the connector 20 includes a molded plastic, hollow, generally parallelepiped-shaped receptacle base 24. In accordance with the present invention, the base 24 is configured for operatively engaging the power switch 18. Specifically, the power switch 18 includes five electrically conductive cylindrical pins 18*a*, and the base 24 is formed with five generally cylindrical receptacles 26 each of which is configured for receiving a respective pin 18*a* therein.

To establish an electrical path between the switch 18 and the power and control circuitry 22 of the vehicle 10, a respective electrically conductive metal contact 28 is positioned in each receptacle 26 of the base 24.

As shown in FIG. 1, each contact 28 includes a comparatively wide partially tubular crimping segment 30 and a comparatively narrow partially tubular crimping segment 32. It can readily be appreciated in reference to FIG. 1 that the wide crimping segment 30 is configured for receiving an insulated segment 34 of a lead 36, with the lead 36 being electrically connected to the power and control circuitry 22 of the vehicle 10. Once the insulated segment 34 is positioned in the wide crimping segment 30, owing to its partially tubular configuration the wide crimping segment 30 can be crimped onto the insulated segment 34 to tightly grip the insulated segment 34.

On the other hand, the narrow crimping segment 32 is configured for receiving an uninsulated segment 38 of the lead 36. If desired, the inner surface of the narrow crimping segment 32 can be scored as shown to facilitate electrical contact between the lead 36 and the contact 28. Once the uninsulated segment 38 is positioned in the narrow crimping segment 32, owing to its partially tubular configuration the narrow crimping segment 32 can be crimped onto the uninsulated segment 38 to tightly grip the uninsulated segment 38.

Figure 5:
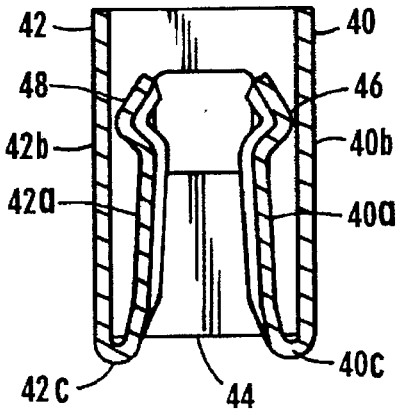
FIG. 5 is a cross-sectional view of one of the receptacle contacts of the present invention, as seen along the line 5—5 in FIG. 2.

In cross-reference to FIGS. 2 and 5, each contact 28 is placed in intimate contact with one of the pins 18*a* of the switch 18 to thereby establish an electrical communication path from the switch 18 to the electrical contact 28. In the presently preferred embodiment shown, each electrical contact 28 is formed with at least two somewhat semi-cylindrical contact elements 40, 42. The elements 40, 42 establish a pin channel 44 therebetween for closely receiving a respective pin 18*a* of the power switch therein. In accordance with the present invention, the contact elements 40, 42 are materially biased toward each other to urge against the pin 18*a* of the power switch 18 when the power switch 18 is engaged with the receptacle base 24.

As shown, the presently preferred embodiment incorporates contacts 28 wherein each contact element 40, 42 defines an inner leg 40*a*, 42*a* and a respective opposed outer leg 40*b*, 42*b* facing the respective inner leg 40*a*, 42*a*. As shown best in FIG. 2, the outer legs 40*b*, 42*b* can be formed integrally as sides of relatively structurally rigid hollow box which surrounds the curved inner legs 40*a*, 42*a*.

Furthermore, a respective bight 40*c*, 42*c* is established between each inner leg 40*a*, 42*a* and its respective outer leg 40*b*, 42*b*. It is to be understood that the inner legs 40*a*, 42*a* bend relative to their respective outer legs 40*b*, 42*b* about the bights 40*c*, 42*c*.

FIG. 5 best shows that each inner leg 40*a*, 42*a* is formed with a respective pressure foot 46, 48 for contacting the respective outer leg 40*b*, 42*b* when the inner legs 40*a*, 42*a* are urged against the outer legs 40*b*, 42*b*. Owing to the comparative rigidity of the box-like structure of the outer legs 40*b*, 42*b*, the outer legs 40*b*, 42*b* are not deformed when the inner legs 40*a*, 42*a* are urged against them. Thereby, deformation of the inner legs 40*a*, 42*a* is limited when the pin 18*a* is engaged with the pin channel 44.

Figure 3:
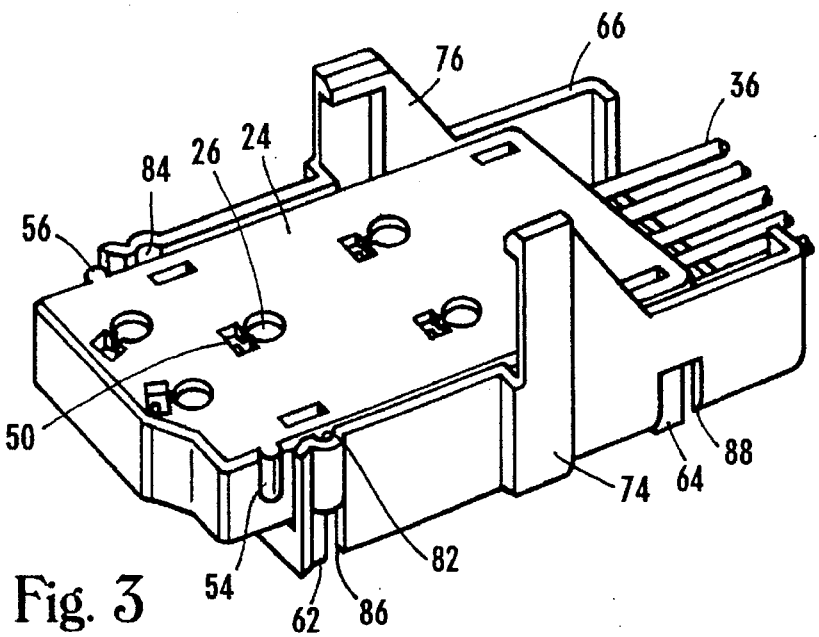
FIG. 3 is a perspective view of the connector in the unlocked position, with the power switch removed for clarity.

The means by which each contact 28 is held within its respective receptacle 26 can be seen in brief cross-reference to FIGS. 2 and 3. Each receptacle 26 is formed integrally with a respective latch spring 50. Also, the box-like structure which establishes the outer legs 40*b*, 42*b* of each contact 28 is formed with an aperture 52, with the aperture 52 being configured for snappingly receiving a latch spring 50 therein to thereby hold the contact 28 in the receptacle 26.

Referring back to FIG. 2, two solid rigid cylindrical keeper ribs 54, 56 are formed on respective opposed long sides 58, 60 of the receptacle base 24. Additionally, two retainer arms 62, 64 are formed on one of the long sides 58 of the receptacle base 24 and depend away (relative to the switch 18) from the base 24.

In accordance with the present invention, a locking cover 66 is reciprocatingly engaged with the receptacle base 24 for locking the switch 18 into electrical contact with the contact 20. As shown in FIG. 2, the locking cover 66 includes a rectangular top surface 68 and two opposed long sides 70, 72 depending away from the top surface 68 toward the base 24.

Each long side 70, 72 is formed with a respective retainer ears 74, 76. And, each retainer ear 74, 76 is formed with a respective locking lobe 78, 80, with the lobes 78, 80 extending inwardly from their respective ears 74, 76 toward each other.

Continuing with the description of the locking cover 66 shown in FIG. 2, each long side 70, 72 is formed with a respective semi-cylindrical outwardly-protruding cavity 82, 84. Additionally, the long side 72 is formed with spaced limiter apertures 86, 88.

Figure 4:
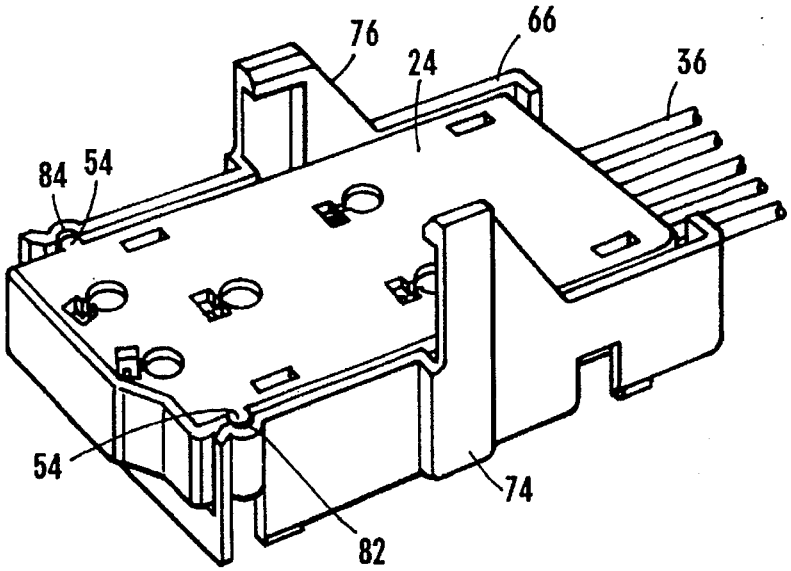
FIG. 4 is a perspective view of the connector in the locked position, with the power switch removed for clarity.

With the above disclosure in mind, the operation of the contact 20 can be seen in cross-reference to FIGS. 3 and 4. As advantageously provided for by the present invention, the locking cover 66 is closely juxtaposed with the base 24 and is slidably engaged therewith for movement to an unlocked position, shown in FIG. 3. In the unlocked position, the power switch 18 can be engaged and disengaged from the receptacle base 24 by moving the switch 18 past the locking ears 74, 76 substantially without deforming the locking ears 74, 76.

Then, with the switch 18 plugged into the base 24, the locking cover 66 can be moved to a locked position shown in FIG. 4. It is to be appreciated that in the locked position, the lobes 78, 80 of the retainer ears 74, 76 engage wedge-shaped protrusions 90, 92 (protrusion 92 shown in phantom)

of the power switch 18 to hold the power switch 18 in a fixed relationship with the receptacle base 24.

It may now also be appreciated that the limiter apertures 86, 88 in the locking cover 66 cooperate with the retainer arms 62, 64 to limit reciprocal movement of the locking cover 66 relative to the retainer base 24. It may be further appreciated that the cavities 82, 84 on the locking cover 66 snappingly receive the keeper ribs 54, 56 to thereby hold the locking cover 66 in the locked position.

When it is desired to disengage the switch from the connector 20, the locking cover 66 is manually moved to the unlocked position shown in FIG. 3. As it is moved, owing to the slight flexibility of the cover 66 the cavities 82, 84 release the ribs 54, 56. In the unlocked position, the protrusions 90, 92 of the switch 18 clear the locking ears 74, 76, thereby permitting unimpeded disengagement of the switch 18 from the base 24 without deforming the ears 74, 76.

While the particular ELECTRICAL CONNECTOR FOR VEHICLE POWER COMPONENT SWITCHES as herein disclosed and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

We claim:

1. An electrical connector for engaging a power switch of a vehicle, comprising:

a receptacle base configured for operatively engaging the power switch; and a locking cover reciprocatingly engaged with the receptacle base and including opposed retainer ears, the locking cover being movable between a locked position, wherein the retainer ears engage the power switch to hold the power switch in a fixed relationship with the receptacle base, and an unlocked position, wherein the power switch can be disengaged from the receptacle base and moved past the locking ears substantially without deforming the locking ears.

2. The connector of claim 1, further comprising:

at least one keeper rib formed on the receptacle base; and at least one cavity formed on the locking cover for snappingly receiving the at least one keeper rib therein to thereby hold the locking cover in the locked position.

3. The connector of claim 2, further comprising:

at least one retainer arm formed on the receptacle base; and at least one limiter aperture formed in the locking cover for cooperating with the retainer arm to limit reciprocal movement of the locking cover relative to the retainer base.

4. The connector of claim 3, wherein the power switch includes a plurality of electrical pins protruding outwardly therefrom, and the retainer base includes:

a plurality of receptacles configured for respectively receiving one of the pins of the power switch therein; and a respective electrical contact disposed in each receptacle and configured for closely receiving one of the pins of the power switch to thereby establish an electrical communication path from the power switch to the electrical contact.

5. The connector of claim 4, wherein each electrical contact is formed with at least two contact elements establishing a pin channel therebetween for closely receiving a respective pin of the power switch therein, the contact elements being materially biased to urge against the pin of the power switch when the power switch is engaged with the receptacle base.

6. The connector of claim 5, wherein each contact element defines an inner leg, an outer leg facing the inner leg, and a bight therebetween, the inner leg of each contact element being formed with a pressure foot for contacting the outer leg and thereby limiting the deformation of the contact element when the pin is engaged with the pin channel of the electrical contact.

7. A vehicle incorporating the electrical connector of claim 1.

8. A motor vehicle, comprising:

an electrical component;

an electrical power source associated with the vehicle;

a power switch;

a receptacle base mounted on the vehicle and configured for operatively engaging the power switch, the receptacle base being electrically connected to the electrical power source; and a locking cover reciprocatingly engaged with the receptacle base and including opposed retainer ears, the locking cover being movable between a locked position, wherein the retainer ears engage the power switch to hold the power switch in a fixed relationship with the receptacle base, and an unlocked position, wherein the power switch can be disengaged from the receptacle base and moved past the locking ears substantially without deforming the locking ears, wherein the power source can be selectively engaged with the receptacle base and manipulated to cause electricity from the power source to operate the electrical component.

9. The vehicle of claim 8, further comprising:

at least one keeper rib formed on the receptacle base; and at least one cavity formed on the locking cover for snappingly receiving the at least one keeper rib therein to thereby hold the locking cover in the locked position.

10. The vehicle of claim 9, further comprising:

at least one retainer arm formed on the receptacle base; and at least one limiter aperture formed in the locking cover for cooperating with the retainer arm to limit reciprocal movement of the locking cover relative to the retainer base.

11. The vehicle of claim 10, wherein the power switch includes a plurality of electrical pins protruding outwardly therefrom, and the retainer base includes:

a plurality of receptacles configured for respectively receiving one of the pins of the power switch therein; and a respective electrical contact disposed in each receptacle and configured for closely receiving one of the pins of the power switch to thereby establish an electrical communication path from the power switch to the electrical contact.

12. The vehicle of claim 11, wherein each electrical contact is formed with at least two contact elements establishing a pin channel therebetween for closely receiving a respective pin of the power switch therein, the contact elements being materially biased to urge against the pin of the power switch when the power switch is engaged with the receptacle base.

13. The vehicle of claim 12, wherein each contact element defines an inner leg, an outer leg facing the inner leg, and a bight therebetween, the inner leg of each contact element being formed with a pressure foot for contacting the outer leg and thereby limiting the deformation of the contact element when the pin is engaged with the pin channel of the electrical contact.

14. In a vehicle including an electrical component and a power switch for operating the electrical component, a receptacle for engaging the power switch to electrically interconnect the power switch and a power source, comprising:

at least one receptacle for receiving a portion of the power switch, the receptacle being formed in a receptacle base configured for operatively engaging the power switch;

a respective electrical contact positioned in the at least one receptacle for electrically contacting the portion of the power switch, the electrical contact including a plurality of contact elements defining a channel therebetween, each contact element defining an inner leg, an outer leg facing the inner leg, and a bight therebetween, the inner leg of each contact element being formed with a pressure foot for contacting the outer leg and thereby limiting the deformation of the contact element when the portion of the power switch is engaged with the channel; and a locking cover reciprocatingly engaged with the receptacle base, the locking cover including opposed retainer ears, the locking cover being movable between a locked position, wherein the retainer ears engage the power switch to hold the power switch in a fixed relationship with the receptacle base, and an unlocked position, wherein the power switch can be disengaged from the receptacle base and moved past the locking ears substantially without deforming the locking ears.

15. The vehicle of claim 14, further comprising:

at least one keeper rib formed on the receptacle base; and at least one cavity formed on the locking cover for snappingly receiving the at least one keeper rib therein to thereby hold the locking cover in the locked position.

16. The vehicle of claim 15, further comprising:

at least one retainer arm formed on the receptacle base; and at least one limiter aperture formed in the locking cover for cooperating with the retainer arm to limit reciprocal movement of the locking cover relative to the retainer base.

* * * * *